US006500035B2

(12) United States Patent
Terlouw

(10) Patent No.: US 6,500,035 B2
(45) Date of Patent: Dec. 31, 2002

(54) WATERJET PROPULSION UNIT

(75) Inventor: Hendrik Terlouw, Krimpen Aan de Lek (NL)

(73) Assignee: HRP Nederland B.V., Krimpen aan de Lek (NL)

( * ) Notice: Subject to any disclaimer, the term of this patent is extended or adjusted under 35 U.S.C. 154(b) by 0 days.

(21) Appl. No.: 10/112,445

(22) Filed: Mar. 28, 2002

(65) Prior Publication Data

US 2002/0160668 A1 Oct. 31, 2002

Related U.S. Application Data

(63) Continuation of application No. PCT/NL00/00705, filed on Oct. 2, 2000.

(30) Foreign Application Priority Data

Oct. 1, 1999 (NL) ..... 1013192

(51) Int. Cl.[7] ..... B63H 25/46
(52) U.S. Cl. ..... 440/38; 114/151
(58) Field of Search ..... 114/151; 440/38, 440/41, 42

(56) References Cited

U.S. PATENT DOCUMENTS 4,147,125 A * 4/1979 Slade ..... 114/151
5,520,557 A 5/1996 Kaul et al.

FOREIGN PATENT DOCUMENTS

| | | |
|---|---|---|
| DE | 44 28 748 A1 | 2/1996 |
| EP | 0 024 443 A | 3/1981 |
| EP | 0 453 101 A1 | 10/1991 |
| GB | 1 312 261 | 4/1973 |
| NL | 16 979 C | 4/1927 |

* cited by examiner

*Primary Examiner*—Ed Swinehart
(74) *Attorney, Agent, or Firm*—Quarles & Brady LLP

(57) ABSTRACT

The invention aims to increase the efficiency of a waterjet propulsion unit with a jet tube, open at its upper and lower end and accommodating a rotating water propulsion means, and with in its outflow opening a rotatable grid of essentially mutual parallel guide plates which cross the axis of the propulsion means under an acute angle, in which a great power can be handled, in that the jet tube is surrounded at the outside of the inlet end by a guide surface having a spherically curved cross-section, and ends at the inlet end in a converging chamber of which two opposite walls an acute angle include with the axis of the propulsion means, said chamber carrying at the outflow end the grid of guide plates of which the plates are parallel with the horizontal end edges of said walls, the whole being rotable together with this grid around the axis of the propulsion means.

5 Claims, 4 Drawing Sheets

WATERJET PROPULSION UNIT

CROSS-REFERENCE TO RELATED APPLICATION

This is a continuation application of PCT/NL00/00705 filed Oct. 2, 2000, which PCT application claims priority of Dutch patent application number 1013192 filed Oct. 1, 1999, herein incorporated by reference.

FIELD OF THE INVENTION

The invention relates to a water jet propulsion unit, comprising a jet tube, open at its upper and lower end, and accommodating therein a rotatingly driven propulsion means with in the outflow opening of the unit a rotatable grid of essentially mutually parallel guide plates crossing the axis of the propulsion element under an acute angle.

DESCRIPTION OF THE PRIOR ART

Such a waterjet propulsion unit is known in itself from the French patent specification 1478733; the propulsion means as used therein is a thrust propeller. This known unit comprises an outer drum around a circular opening in the bottom of the vessel, extending conically upwardly with therein a jet tube, converging downwardly, and with therebelow the grid guide plates.

Such a device is, at best, only suited for handling small powers. The inflow of the water at the upper end of the jet tube will be accompanied by heavy turbulences, resulting in a very low propeller efficiency and cavitation of the propeller. The plane of the exit grid essentially coincides with the plane of the bottom of the vessel so that a great amount of water will be pumped around: part of the outflowing water will be mixed with the inflowing water so that the efficiency of the propulsion unit will be still worse.

SUMMARY OF THE INVENTION

The invention aims to provide a propulsion unit as described hereinabove which, having a high efficiency, is suitable to handle high powers. According the invention this aim is obtained in that the jet tube is, outside the inlet end, surrounded by a curved guide surface which has, in cross-section in a radial plane through the axis of the jet tube and starting from the wall of said tube an at least semi-circular configuration, and ends at the outlet end in a guide chamber in which the end edges of two opposite walls, which bound the outflow opening of said chamber, cross the axis of the tube under an acute angle, said grid of plates being provided in said outflow opening with at least the end parts of the plates parallel to said end edges, the whole being rotatable, together with the grid, around the axis of the propulsion means.

The upper surround of the jet tube as proposed by the invention ensures a smooth inflow of the water therein, eliminating turbulences and propeller cavitation. The water which flows out of the jet tube does not directly hit the guide plates but flows firstly in the, converging, chamber in which the water is already given a direction which includes an angle with the axis of the propulsion means. By this the "pumping around", which occurs in the unit according to the prior art, is prevented.

Preferably the propulsion means is a propulsion propeller with fixed or variable pitch. It is also possible to use a "mixed flow" propeller or a pumping disc.

In a preferred embodiment the chamber is fixed to the jet tube and rotatable, together therewith, around the axis of the propulsion means by means of drive means, acting on the jet tube.

Contrary to the prior art according to which the guide grid can be rotated by means of a submerged set of gears, in the proposed embodiment the rotating of the jet tube is effected by driving its support, thus in the dry zone within the vessel.

Contrary to the prior art in a preferred embodiment of the invention the jet tube is surrounded by an essentially circle-cylindrical drum of which the lower plane essentially coincides with the plane of guide plate grid. By this measure a better guiding of the water, which is sucked in around the jet tube, up to the upper end of the jet tube is obtained.

Furthermore preferably the guide plates comprise a first part lying near to the outflow opening of the chamber, parallel with the chamber valves which cross the axis of the propulsion means, and a second part, lying further within the chamber and crossing the said axis under a smaller angle.

BRIEF DESCRIPTION OF THE DRAWINGS

The invention is elucidated on the hand of the drawing. Therein shows.

DESCRIPTION OF THE PREFERRED EMBODIMENT

Figure 1:
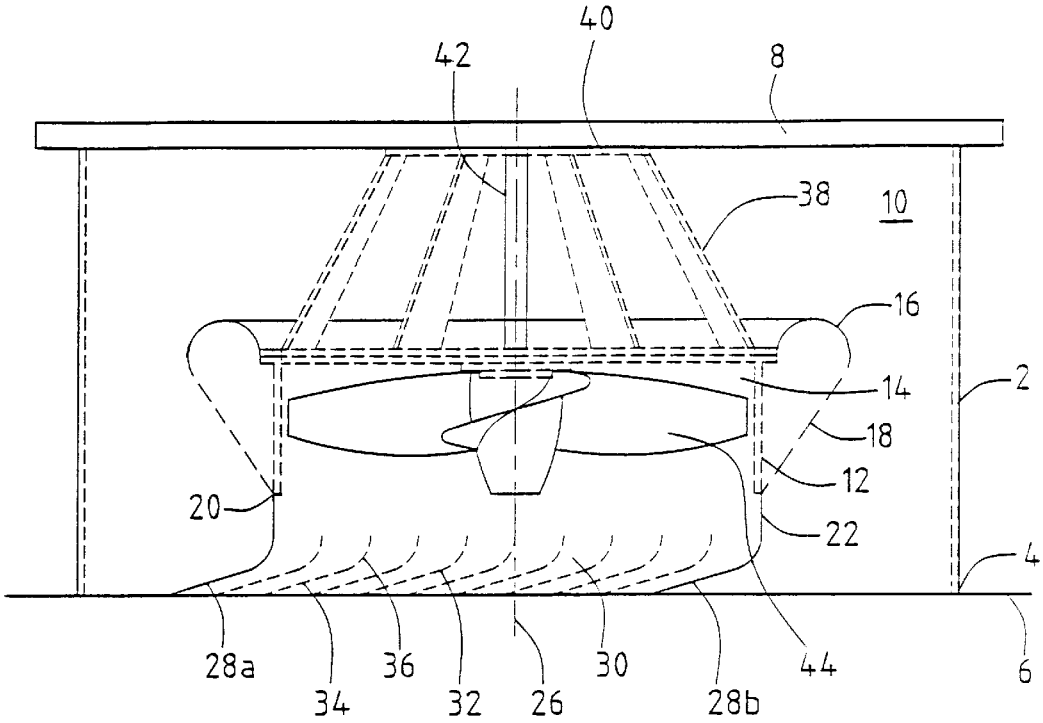
FIG. 1 a schematical cross-section through a unit according to the invention in a direction parallel to the planes of the guide plates.
Figure 2:
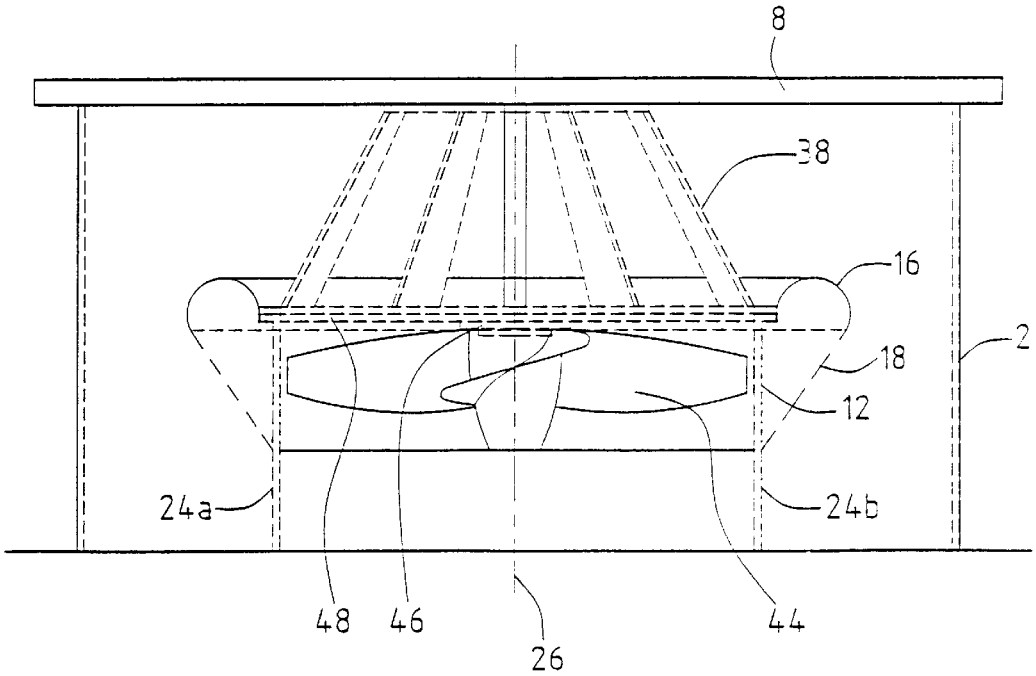
FIG. 2 a similar cross-section in a direction perpendicular thereto.
Figure 3:
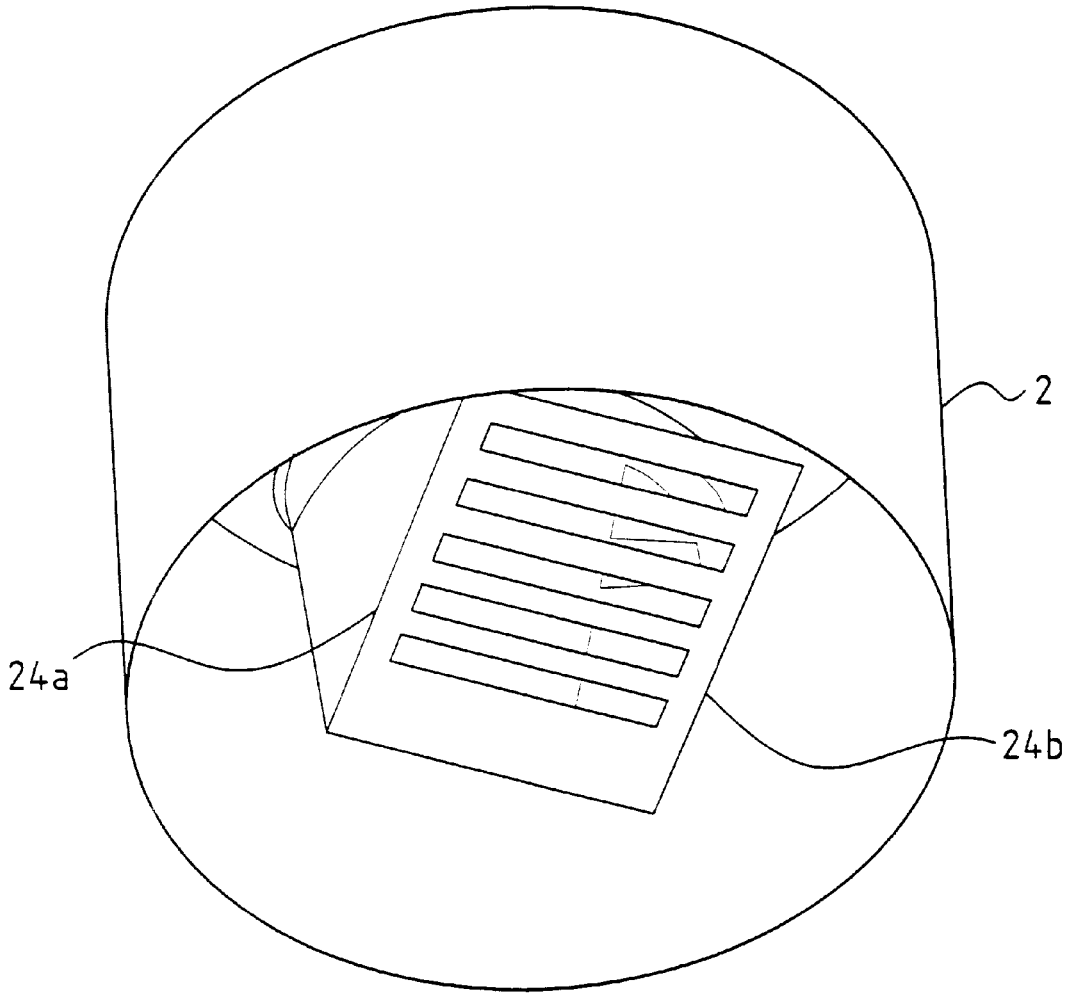
FIG. 3 a schematic lower view of the unit according to the invention.
Figure 4:
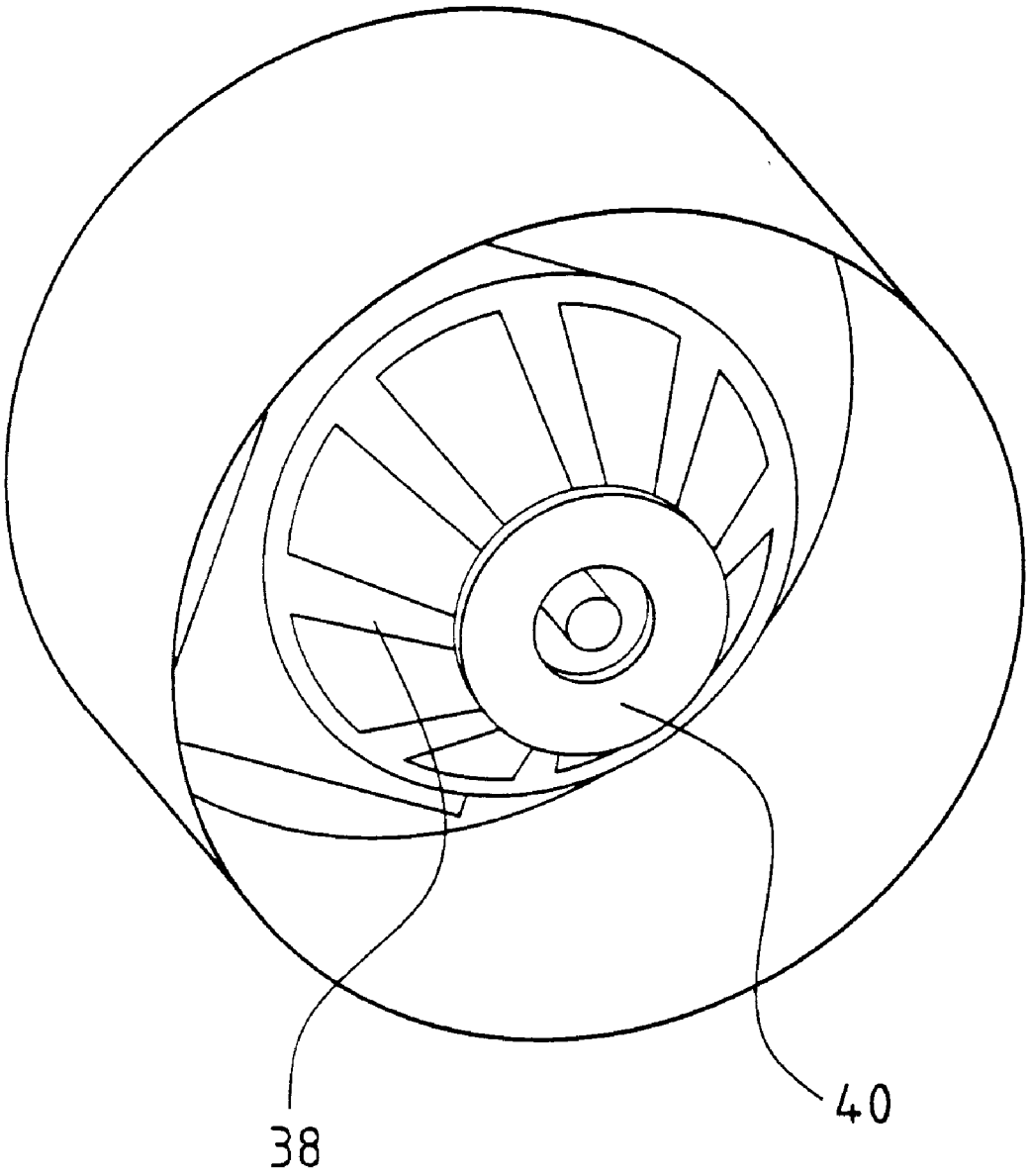
FIG. 4 a schematic upper view of such a unit.

The unit shown in the drawings comprises a cylindrical drum 2 of which the lower edge 4 is sealingly connected to the bottomplane 6 of a vessel, not further shown, and provided with this unit. At its upper end the drum 2 is closed by closed supporting structure 8, which prevents surrounding water in the space 10 of the drum from penetrating into the vessel and which furthermore provides a rotating support for the various components of the propulsion unit.

These further components comprise a cylindrical jet tube 12 of which the upper, inlet end 14 is surrounded by a guide surface 16 with spherical cross-section, which is via suitable connecting elements, schemically shown by the broken line 18, connected to the jet tube 12. At the lower end 20 the jet tube 14 merges into a guide chamber 22 with essentially rectangular cross-section of which two mutually parallel planes, 24*a,* 24*b,* are parallel to the axis 26 of the chamber 12 while the two other planes, 28*a,* 28*b,* enclose an acute angle with this axis. The chamber 22 carries at the lower end a grid 30 which is made up of individual guide plates 32, each comprising a first part 34, essentially parallel to the walls 28*a,* 28*b* and, starting therefrom, a part 36 which encloses with the axis 26 a smaller angle.

The jet tube 12 is connected, by means of a number of supporting strips 38, to a central supporting plate 40 which is suspended in the cover plate 8. Through this supporting plate 40 goes the shaft 42 which carries at its lower end the propulsion propeller 40 which closely fits within the jet tube 12.

The shaft 42 is coupled to a driving motor (not shown), and is supported at its lower end, near to the propeller 42, in a bearing 46 which is connected by means of radial arms 48 to the jet tube 12.

Figure 5A:
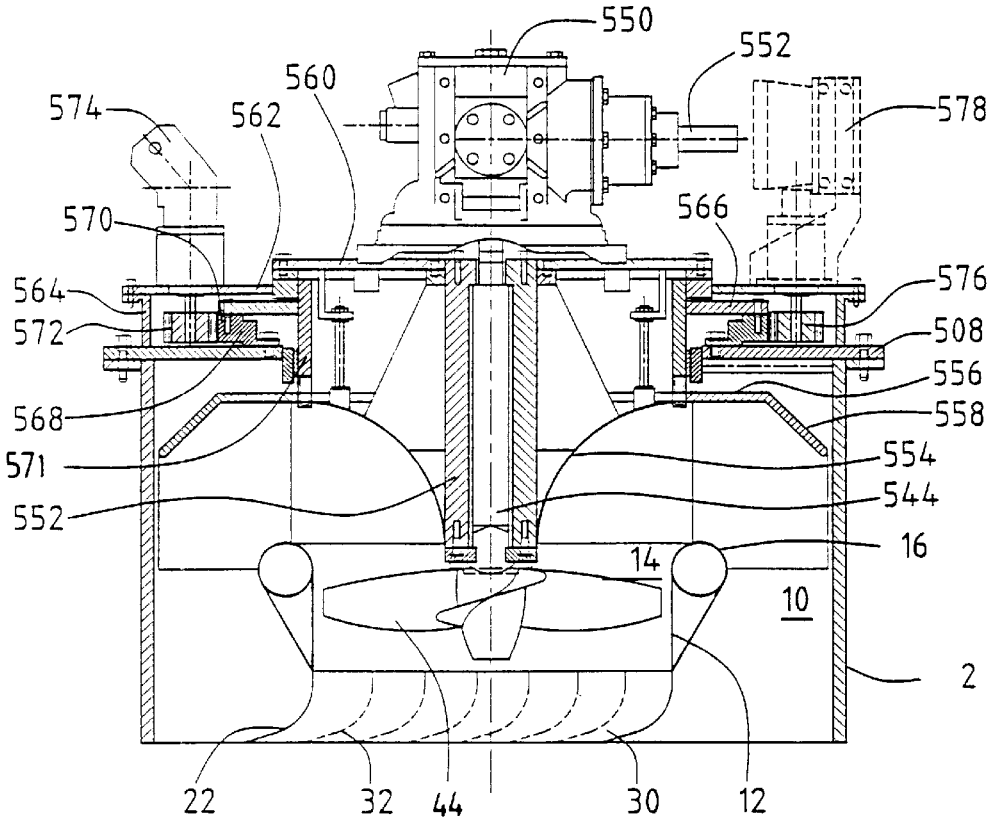
FIG. 5*a* shows in cross-section, and FIG. 5*b* in lower view a practical realisation of the device according to the invention. In these figures parts, which have already been shown in preceding figures, are denoted with reference numerals as used therein with the prefix "5".
Figure 5B:
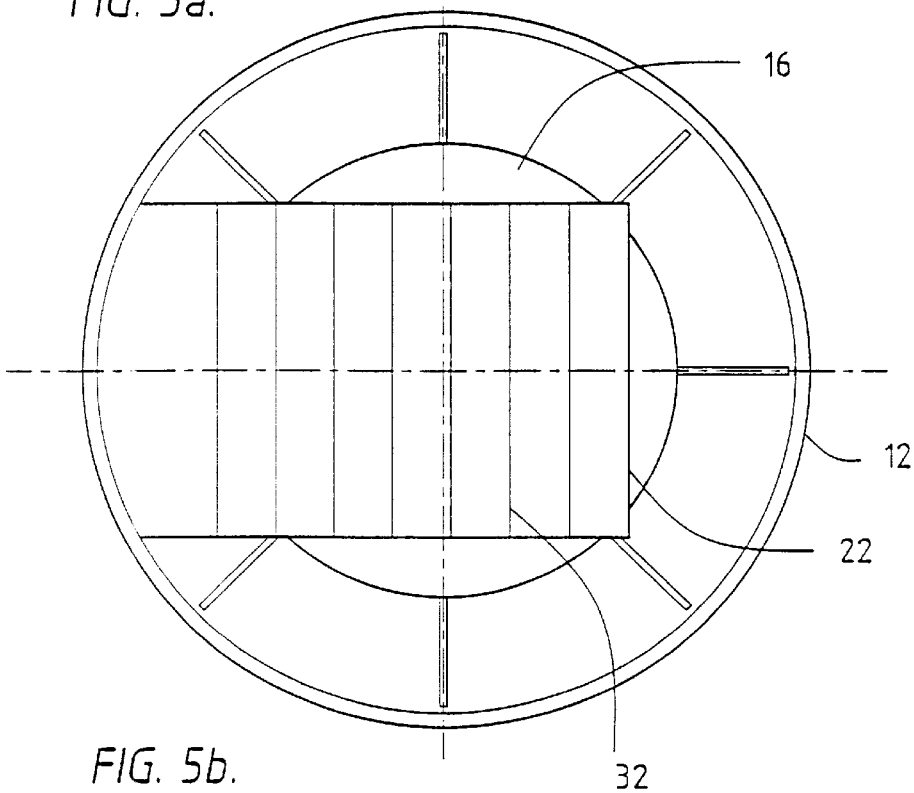

The FIGS. 5*a* and 5*b* show a cylindrical drum 2 supported by the upper carrying structure 508; the space, enclosed by this drum 2, is denoted with 10 and in this space lies the jet tube 12, of which the upper end 14 is surrounded by the guide surface 16 with spherical cross-section. At the lower end the jet tube 12 merges into the guide chamber 22 with the grid 30, made up of individual guide plates 32 which have a structure as described hereinbefore.

The propeller 44 is supported by the shaft 44 which is connected to the output shaft of a transmission 550 of which the input shaft 552 is connected to the driving engine (not shown).

The drawing also shows the curved guide plates 554 which guide the inflowing water along the inner edge thereof to the jet tube 12. They extend into the radial ring-shaped shielding plate 556 which merges into a conical, downwardly directed, end part 558.

The shaft sleeve 552 is carried by the upper supporting plate 560 upon which rests the transmission 550 and which is connected, via the outer supporting ring 562 and a short upstanding cylindrical part 564, to the upper plate 508. The complete comprising jet tube 12 with guide chamber 522 and the curved shielding plates 554 depends from the carrying cylinder 57 with, protruding therefrom, the radial supporting ring 566, carried by the bearing 568 and provided with a ring gear 570; a gear 572 on the output shaft of the setting motor 574 meshes therewith and the ring gear drives via the gear 576 the position detector 578 which supplies digital information relating to the orientation of the jet tube, and therewith the orientation of the propulsion unit.

The above described measures result into a propulsion unit with properties which are markedly better than same of the prior art.

What is claimed is:

1. Water jet propulsion unit, comprising a jet tube, open at its upper inlet and lower outlet end, and accommodating therein a rotatingly driven propulsion means with in the outflow opening of the unit a rotatable grid of essentially mutually parallel guide plates crossing the axis of the propulsion means under an acute angle, in which the jet tube is, outside the inlet end, surrounded by a curved guide surface which has, in cross-section in a radial plane through the axis of the jet tube and starting from the wall of said tube an at least semicircular configuration, and ends at the outlet end in a guide chamber in which the end edges of two opposite walls, which bound the outflow opening of said chamber, cross the axis of the tube under an acute angle, said grid of plates being provided in said outflow opening with at least the end parts of the plates parallel to said end edges, the whole being rotatable, together with the grid, around the axis of the propulsion means.

2. Waterjet propulsion unit according to claim 1, in which the propulsion means is a propulsion propeller.

3. Waterjet propulsion unit according to claim 1, in which the chamber is fixed to the jet tube and can be rotated, together therewith, by drive means acting upon the jet tube.

4. Waterjet propulsion unit according to claim 1, in which the jet tube is surrounded by an essentially circle-cylindrical drum, of which the lower plane essentially coincides with the plane of the guide plate grid.

5. Waterjet propulsion unit according to claim 1, in which the plates of the guide plate grid comprise a first part, lying near to the outflow opening of the chamber, parallel to the chamber walls which cross the axis of the propulsion means, and a second part, lying further inwardly of the chamber and crossing said axis under a smaller angle.

* * * * *